US006385802B1

(12) United States Patent
Roberts et al.

(10) Patent No.: US 6,385,802 B1
(45) Date of Patent: May 14, 2002

(54) OPERATING ROOM TABLE HAVING LUMBAR SUPPORT BAR

(75) Inventors: Christopher H. Roberts, Joplin, MO (US); Robert C. Freed, North Oaks, MN (US)

(73) Assignee: Bamcor, Inc., Minneapolis, MN (US)

( * ) Notice: Subject to any disclaimer, the term of this patent is extended or adjusted under 35 U.S.C. 154(b) by 0 days.

(21) Appl. No.: 09/466,500

(22) Filed: Dec. 17, 1999

(51) Int. Cl.[7] ..... A61G 13/12
(52) U.S. Cl. ..... 5/621; 5/624; 5/612; 5/648
(58) Field of Search ..... 5/621, 624, 612, 5/648, 630, 632, 633; 128/845; 606/242

(56) References Cited

U.S. PATENT DOCUMENTS

| | | | | | |
|---|---|---|---|---|---|
| 1,866,696 | A | * | 7/1932 | Birman | 5/612 |
| 3,722,010 | A | | 3/1973 | Saternus | |
| 3,873,081 | A | * | 3/1975 | Smith | 5/621 |
| 3,958,283 | A | | 5/1976 | Adams et al. | |
| 4,025,972 | A | | 5/1977 | Adams et al. | |
| 4,444,381 | A | * | 4/1984 | Wayne | 5/621 |
| 4,583,725 | A | * | 4/1986 | Arnold | 5/621 |
| 4,669,136 | A | | 6/1987 | Waters et al. | |
| 4,865,303 | A | | 9/1989 | Hall | |
| 5,074,000 | A | | 12/1991 | Saltani et al. | |
| 5,142,720 | A | * | 9/1992 | Kelso et al. | 5/630 |
| 5,180,386 | A | * | 1/1993 | Kennedy, Jr. | 5/630 |
| 5,390,383 | A | * | 2/1995 | Carn | 5/624 |
| 5,577,279 | A | | 11/1996 | Foster et al. | |
| 5,784,730 | A | | 7/1998 | Hunt | |
| 5,839,134 | A | | 11/1998 | Matsuura et al. | |

FOREIGN PATENT DOCUMENTS

CA 654521 * 12/1962 ..... 5/612

OTHER PUBLICATIONS

Romanowski, Len; Reich, Harry; McGlynn, Fran; Adelson, Mark; Taylor, Patrick, Brachial plexus neuropathies after advanced laparoscopic surgery, Fertility and Sterility, vol. 60, No. 4, Oct. 1993, USA.

* cited by examiner

*Primary Examiner*—Michael F. Trettel
(74) *Attorney, Agent, or Firm*—Moore & Hansen

(57) ABSTRACT

The present invention is directed to a pivotal operating room table having a main surface and an elongated support member. The main surface preferably lies generally in a first plane and is pivotal end to end such that the first plane can pass through a second generally vertical plane as the main surface pivots to end to end. A second plane is generally perpendicular to the first plane. The elongated support member is adjustably interconnected with the operating room table, and provides a support surface lying generally in a third plane which is generally perpendicular to the second plane when the elongated support member is interconnected with the table. In preferred embodiments the elongated support member is adjustably interconnectable with the table at any of a plurality of heights above the main surface and it further includes an elongated support bar and an inflatable bladder resting above the elongated support bar. In preferred embodiments the operating room table will include a pair of elongated, parallel side rails on opposite sides of the main surface and interconnected with the main surface and generally parallel thereto. The elongated support bar is adjustably interconnectable with each of the side rails. In alternate embodiments, the third plane may be oriented at an angle to the first plane, however in preferred embodiments the third plane will be generally parallel with the first plane. Methods of supporting a patient on a pivotal surface during a surgical procedure are also disclosed.

21 Claims, 8 Drawing Sheets

OPERATING ROOM TABLE HAVING LUMBAR SUPPORT BAR

BACKGROUND OF THE INVENTION

1. Field of the Invention

The present invention relates to operating room tables or surgical tables and, in particular, to operating room tables having an articulated or pivotal table top and appropriate controls for supporting a patient in a number of desired positions, most particularly, in a Trendelenberg's position or in a reverse Trendelenberg's position.

2. Description of the Background

Operating room tables which pivot or articulate to allow surgeons to place their patients in a particular position suitable for a particular surgical or other procedure are well known in the art. Hall (U.S. Pat. No. 4,865,303) describes one such table having a number of pivot points and pivot actuators which allow the table to pivot from end to end about a vertical plane (see FIGS. 13 and 14). Many other tables, having similar features, are well known in the art.

Over the years, physicians have found such tables to be useful when it is necessary to conduct surgical procedures which require the positioning of a patient in either a Trendelenberg's position or a reverse Trendelenberg's position. The Trendelenberg's position is generally employed in laparoscopic procedures in the pelvic region. In this position, the patient's pelvis is elevated above the patient's head so that the intestines are drawn away from the pelvis toward the upper abdomen, thereby simplifying these laparoscopic procedures. In a reverse Trendelenberg's position, the head is elevated above the abdomen allowing the intestines to fall toward the pelvis making it easier to conduct laparoscopic procedures in the upper abdomen. Common laparoscopic procedures conducted when the patient in is in a Trendelenberg's position include procedures in the pelvic region involving the uterus, the ovaries, and other pelvic organs. Laparoscopic procedures directed to the upper abdomen which are generally conducted in the reverse Trendelenberg's position include procedures relating to the gall bladder, hiatal hernias, liver biopsies, lymph node sampling around the stomach and the upper aorta, and the like.

Laparoscopic surgical techniques employing these surgical positions were advanced during the late 1970s. When patients undergo procedures in the Trendelenberg's position, they are generally provided with a shoulder brace of one kind or another to support them and prevent them from sliding off the table. The length of these procedures, as with most surgical procedures, is believed to influence the associated quantity and type of morbidity. Lengthy procedures where the patient is in a 20–40% Trendelenberg's position in shoulder braces, may provide unequal shoulder support or permit abduction of the arm to about 90° or more, and may also predispose patients to a variety of neurologic sequelae. One of the most common causes of post-operative upper extremity neuropathy is compression and/or stretching of the brachial plexus which can result from such a procedure (see, for example Romanowski, L. et al., Brachial Plexus Neuropathies After Advanced Laparoscopic Surgery, Fertility and Sterility, 1993, 60:729–732; Westin, B, Prevention of Upper-Limb Nerve Injuries in Trendelenberg's position Acta Chire Scand, 1959, 108,61–67; Wright, I. S., The Neurovascular Syndrome Produced by Hyper abduction of the Arms, A. M. Heart J. 1949, 29: 1–19; and Costly, D. O., Peripheral Nerve Injury, INT. Anesthesiol. Clin., 1972, Ken: 189–206.) It is believed that neuropathic injury, specifically brachial plexus injury, may persist as a relatively common operative complication unless the current generation of gynecological surgeons and other health care providers are familiar with both the etiology risk factors and preventive measures for brachial plexus stretch and/or injuries. A significant risk factor associated with laparoscopic gynecological procedures conducted when the patient is in the Trendelenberg's position, as commonly practiced, is using pivotal surgical tables equipped with shoulder braces, harnesses or other devices designed to support or "catch" the patient's shoulders in order to prevent the patient from sliding off the table.

It will be appreciated, therefore, that improvements over the presently available surgical or operating room tables, which could minimize the frequency of brachial plexus neuropathies and other neuropathies associated with laparoscopic gynecological procedures conducted in the Trendelenberg's position, would be a welcomed contribution to medical practice, and that prior art operating room or surgical tables present problems which are in need of solution. The present invention provides solutions for these and other problems.

SUMMARY OF THE INVENTION

The present invention is directed to a pivotal operating room table having a main patient support section having a main surface which lies in a first plane, and an elongated support member adjustably interconnectable to the main patient support section. The main patient support section is pivotally interconnected with a table support system such that the main surface can pass through a second generally vertical plane as the main patient support section pivots with respect to the table support system. The elongated support member includes an elongated support block, the support block having an upper surface area which includes a secondary support surface lying generally in a third plane. The third plane is generally perpendicular to the second plane when the elongated support member is interconnected with the main patient support section. The elongated support member is preferably adjustably interconnectable with the main patient support section at any of a number, preferably a myriad of heights above the main surface. In preferred embodiments the elongated support member includes an inflatable bladder resting above the secondary support surface. In further embodiments the operating room table will include a pair of elongated, parallel side rails on opposite sides of the main surface and interconnected with the main patient support section and generally parallel to the main surface. The elongated support member is adjustably interconnectable with each of the side rails. In alternate embodiments, the third plane may be oriented at an angle to the first plane, however, in certain embodiments, the third plane will be generally parallel with the first plane. As will be appreciated, in alternate embodiments the support block can pivot so that the third plane will pivot with respect to the first plane.

In other embodiments, the present invention provides an elongated support attachment for attachment to a pivotal operating room table. The preferred support attachment includes an elongated support member interconnected to a pivotal operating room table at a number of heights above a main surface of the table. The elongated support member preferably has a relatively hard underlying support surface and a relatively soft compressible overlying support covering above the underlying support surface. The overlying support covering preferably includes relatively soft support materials such that the overlying support covering can be compressed when bearing weight. The support materials preferably include an expandable bladder which can be inflated and deflated so as to contain varying amounts of air and to provide varying amounts of compressible cushioning capacity.

The present invention also provides methods of supporting a patient on a pivotal operating room table during a surgical procedure. In one embodiment, the method includes providing a pivotal operating room table having a main surface and an elongated support member adjustably interconnected therewith which provides a secondary support surface which can be adjustably secured at any of a number of heights above the main surface. This embodiment preferably includes the steps of (1) positioning the patient supine on both the pivotal main surface and the secondary support surface such that the secondary support surface is in contact with the lower lumbar region of the patient's back; and (2) orienting the pivotal main surface such that the patient's buttocks are elevated above the patient's head in a Trendelenberg's position; wherein the secondary support surface is positioned immediately below the lower lumbar region of the patient's back and/or the upper portion of the patient's buttocks so as to resist gravitational forces pulling the patient in a generally downward direction. In preferred embodiments, the step of positioning includes inflating an inflatable bladder resting on the secondary support surface to permit the elongated surface to conform in part to the shape of the patient's back proximate the secondary support surface.

In a further embodiment, the method includes positioning the patient supine on both the pivotal main surface and the elongated support surface such that the elongated support surface is in contact with a lower portion of the patient's buttocks; and orienting the pivotal main surface such that the patient's head is elevated above the patient's buttocks in a reverse Trendelenberg's position; wherein the elongated support surface is positioned immediately below the patient's buttocks and the lower portion of the patient's buttocks rests at least partially against at least one of the edges of the elongated surface to resist gravitational forces pulling the patient in a generally downward direction. In preferred embodiments, the step of positioning includes inflating the bladder to permit the elongated support member to conform in part to the shape of the patient's back proximate the lower portion of the patient's buttocks where the elongated support member comes into contact therewith.

It is an object of the present invention to provide a pivotal operating room table which will permit the physician to conduct a laparoscopic surgical procedure when the patient is in preferably either a Trendelenberg's position or a reverse Trendelenberg's position, while minimizing the chance of causing brachial plexus injuries due to brachial plexus stretching and/or compression.

These and various other advantages of novelty that characterize the present invention are pointed out with particularity in the claims which are appended hereto and form a further part hereof. For better understanding of the present invention, however, its advantages and other objectives attained by its use, reference should be made to the drawings, which form a further part hereof, and to the accompanying descriptive matter, in which there is illustrated and described preferred embodiments of the present invention.

BRIEF DESCRIPTION OF THE DRAWINGS

The present invention will be described in connection with the accompanying drawings, in which common reference numerals refer to the same or similar parts of the respective embodiments.

DETAILED DESCRIPTION OF THE PREFERRED EMBODIMENTS

Figure 1A:
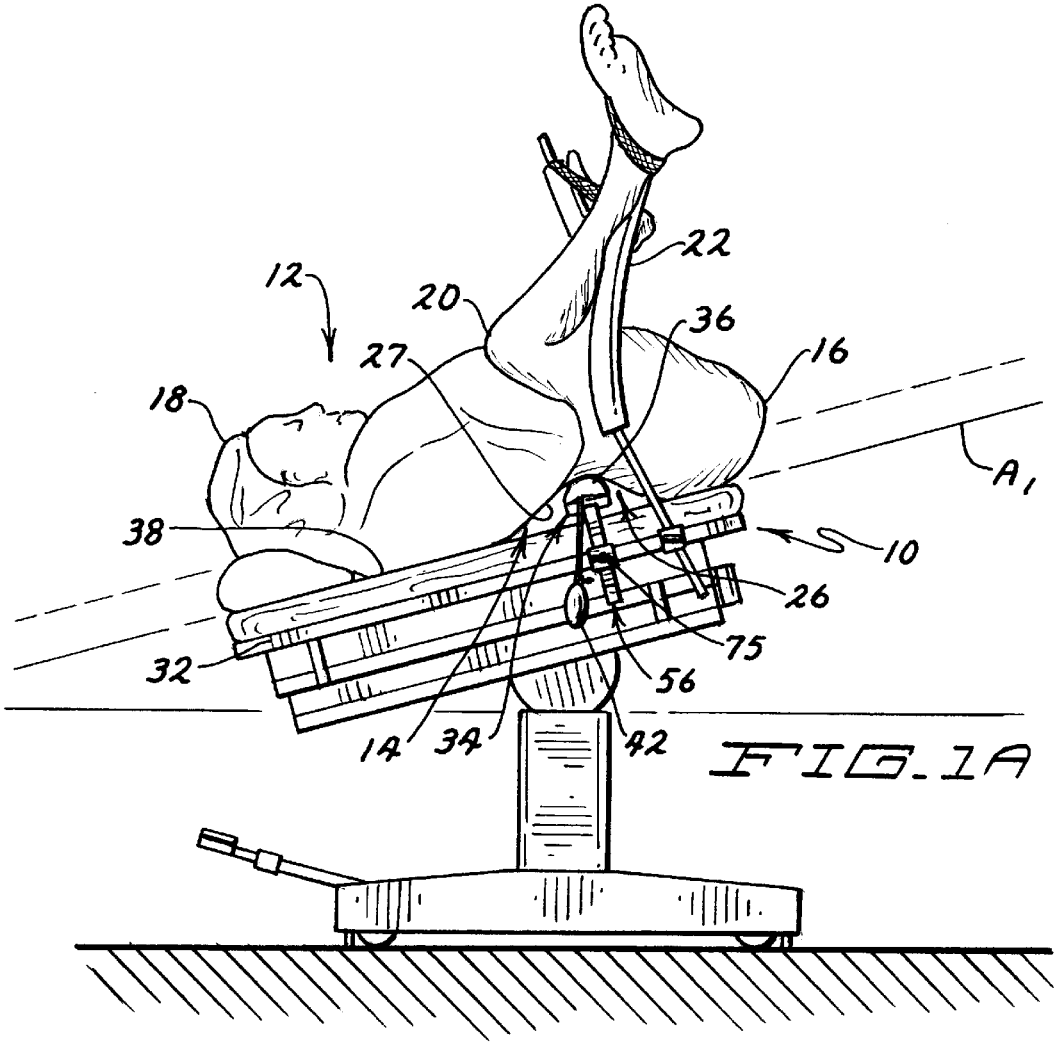
FIG. 1A is a side view of a patient in a Trendelenberg's position on an operating room table of the present invention.
Figure 2:
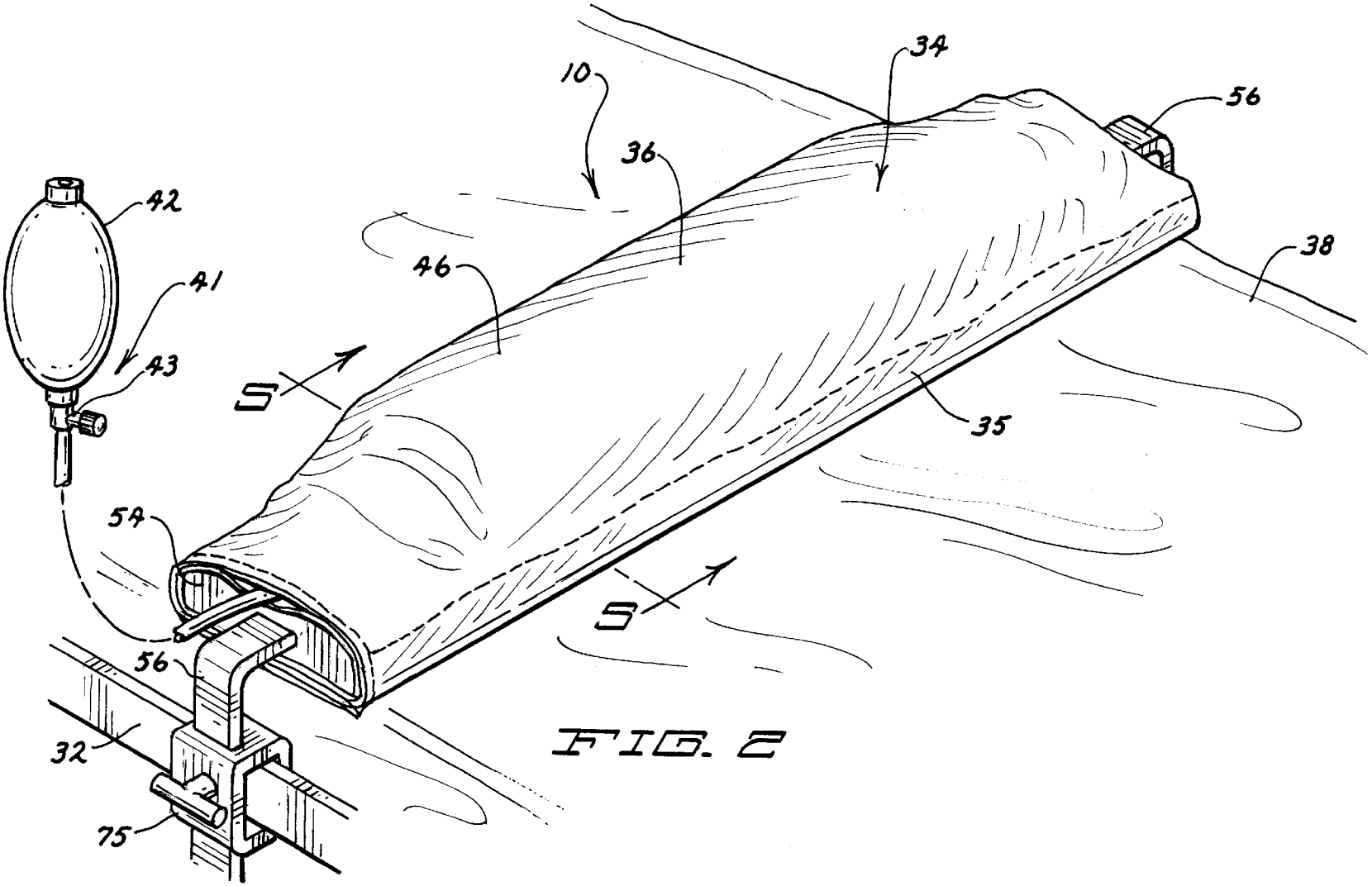
FIG. 2 is an enlarged perspective view of an elongated support member similar to that shown in FIGS. 1A and 1B.
Figure 3:
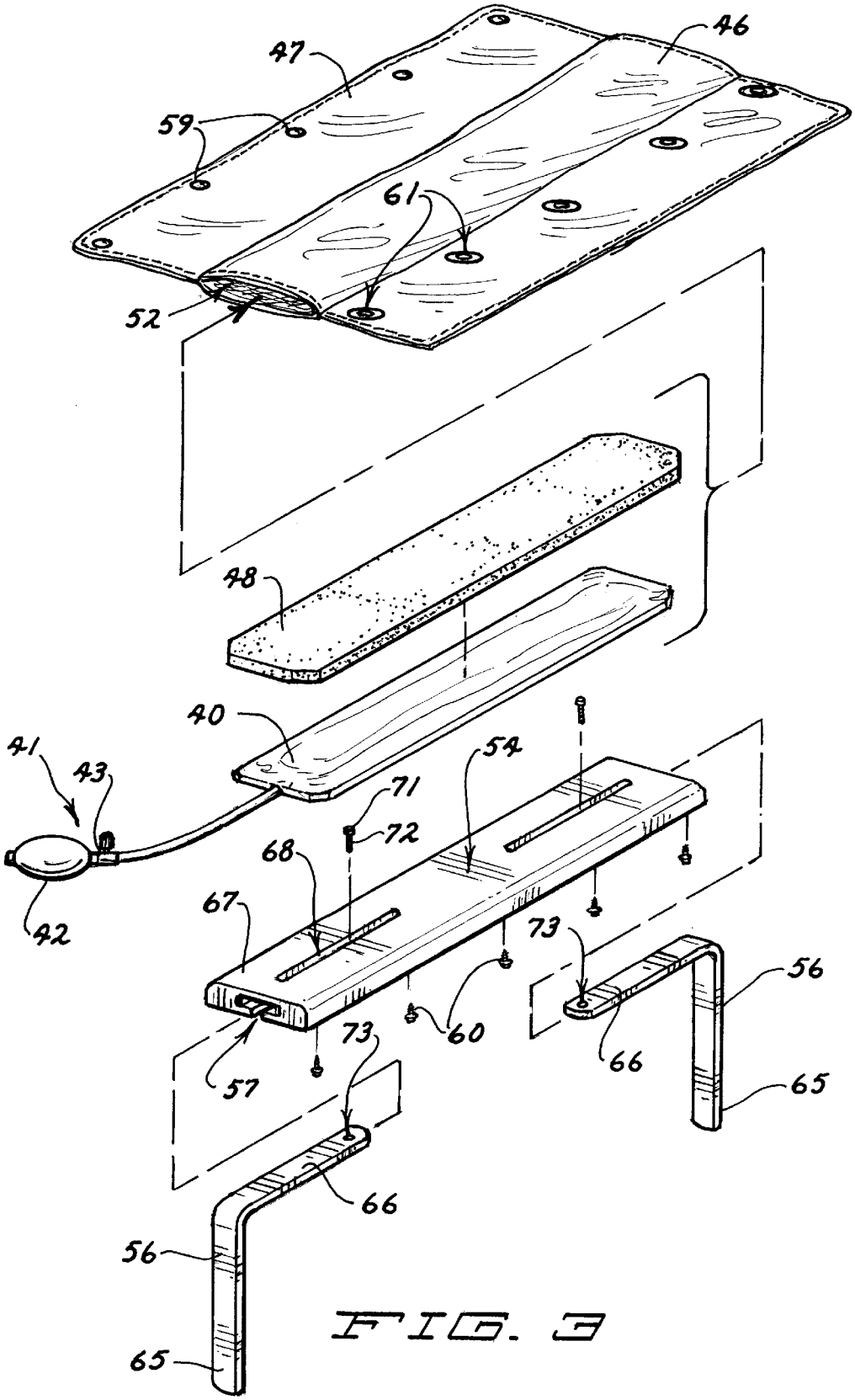
FIG. 3 is an exploded perspective view of the elongated support member shown in FIG. 2.

Referring now to the drawings and to FIG. 1A in particular, a pivotal operating room table 10 of the present invention is shown. A patient 12 is shown lying supine on the patient's back on a main patient support section 37 having a main surface 38 of the operating room table 10 in a Trendelenberg's position. The main surface 38 of the main patient support section 37 pivots with respect to the table support system 39 of the OR table 10. The patient's buttocks 16 are elevated above the patient's head 18 and shoulders 19, and the patient's legs 20 are up in stirrups 22. The table 10 has elongated side rails 32 to which an elongated support member 34 is adjustably secured. The patient's back 14 includes the patient's shoulders 19 and a lumbar region 26, which includes an upper lumbar region 27 and a lower lumbar region 28, immediately adjacent the buttocks 16. The lower lumbar region 28 is engaged with an upper surface 36 of the elongated support member 34 in a surgical position suitable for conducting laparoscopic procedures in the pelvic region. Healthcare professionals can position the patient 12 supine on both the main surface 38 of the operating room table 10 and the upper surface 36 of the elongated support member 34 in preparation for laparoscopic surgical procedures. Referring now also to FIGS. 2 and 3, the upper surface 36 is supported by a secondary support surface 53 (not shown in FIG. 1A) of a block material 54 (not shown in FIG. 1A) within the elongated support member 34 which provides a hardened surface. In this embodiment, the secondary support surface 53 will lie in a plane represented by dashed line $B_1$ consistent with or parallel to a primary plane consistent with line $A_1$ in which the main surface $A_1$ lies. Preferably, the patient will be awake and relatively alert when the patient is first placed on the operating room table 10. The operating room table 10 will generally be in a horizontal orientation (not shown) consistent with a horizontal plane consistent with line H when the patient is first positioned on the table 10. The elongated support member 34 may be already raised to a height above the main surface 38 believed to be sufficient to provide the necessary resistance to gravitational forces placed upon the patient, which would otherwise cause the patient to slide generally in a downward direction along the main surface 38 when the table 10 is tilted from the generally horizontal orientation consistent with horizontal plane H to a different orientation consistent with a slanted plane $A_1$ to put the patient 12 in the Trendelenberg's position shown in FIG. 1A. Prior to tilting the table 10, the elongated support member 34 will generally be raised if it is not. When the table 10 is tilted, the planes in which the main surface 38 and the secondary support surface 53 lie will each pass through a perpendicular surface of the paper upon which FIG. 1A is illustrated. Once anaesthesia is provided to the patient, an inflatable bladder 40, shown in FIG. 3 can be inflated using the bulb 42 and check valve mechanism 41 which is similar to, and works in the same manner as a bulb compression pump (not shown) of the type used in an arm cuff for taking blood pressure readings. The check valve mechanism 41 includes a check valve 43 to control air flow out of the bladder 40. It will be appreciated that other well known methods for inflating bladders may be used in substitution for this mechanism and that these other mechanisms are well within the scope of the present invention.

Figure 1B:
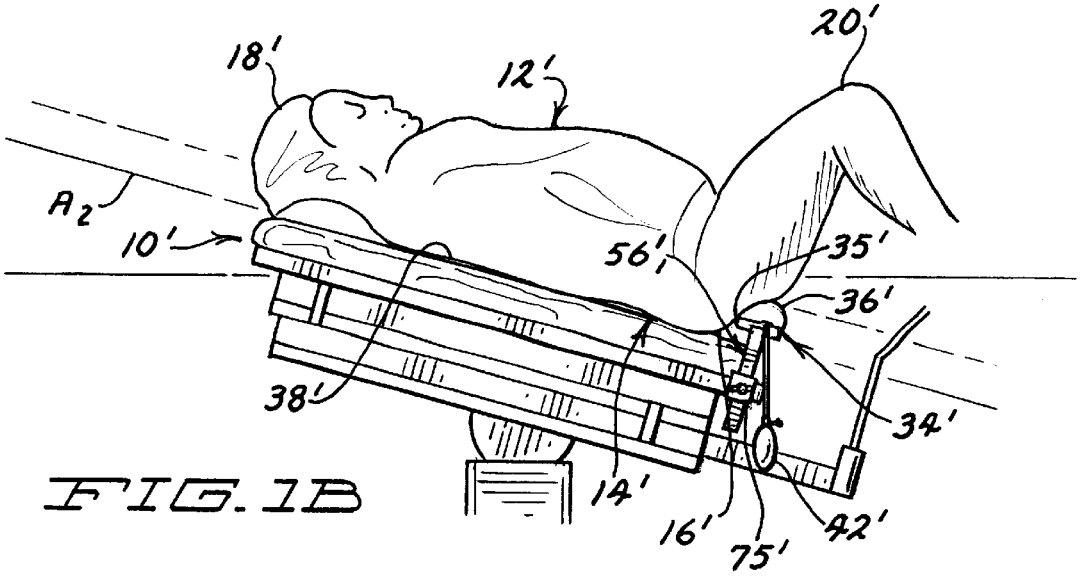
FIG. 1B is a side view similar to that shown in FIG. 1A showing a patient in a reverse Trendelenberg's position on an operating table of the present invention which is similar to the table shown in FIG. 1A.

Referring now also to FIG. 1B, a similar operating room table 10' is shown in which a patient 12' is shown in a reverse Trendelenberg's position wherein the patient 10' is in a supine position upon the main surface 38' and the patient's buttocks 16' are up against an edge 35' of the upper surface 36' of the elongated support member 34'. In this case, as in the embodiment referenced in the discussion regarding FIG. 1A, the plane $B_2$ in which the secondary support surface (not shown) lies is consistent with or parallel to the plane $A_2$ in which the main surface 38' lies; and both of these planes pass through a vertical plane consistent with the paper on which FIG. 1B is illustrated when the main patient support section 37' and the support member 34' pivot with respect to the table support system.

Referring now also to FIGS. 2–8, the preferred elongated support member 34, of FIG. 1A, having an outer encasement 46 is shown. The outer encasement is preferably made from a rubberized washable fabric which is soft to the touch and provides a non-sticky engagement surface on the elongated support member 34. In preferred embodiments, this washable fabric is made of a Super-soft Dartex™ cover material from the Dartex Corporation in the United Kingdom and available from Dynamic Systems, Incorporated, Leichaster, N.C. This material is preferably impregnated with an antimicrobial agent or agents, is water impermeable up to 250 mmhg to keep extraneous fluids from entering the material.

Figure 5:
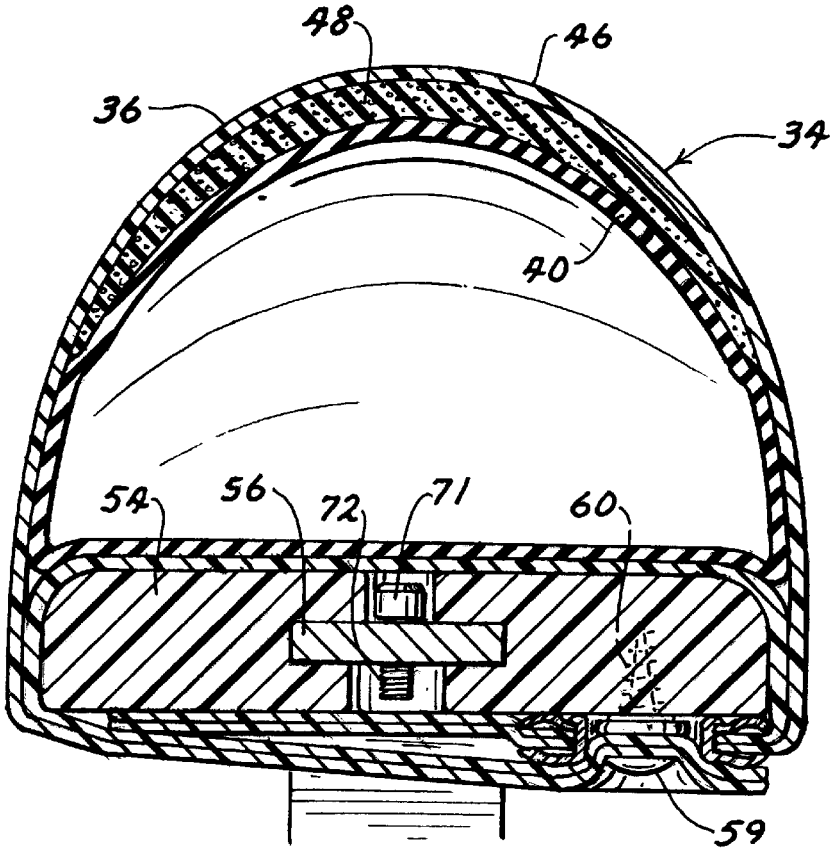
FIG. 5 is a cross sectional view of the elongated support member shown in FIG. 2 as seen from the Line 5—5 of FIG. 2.
Figure 4:
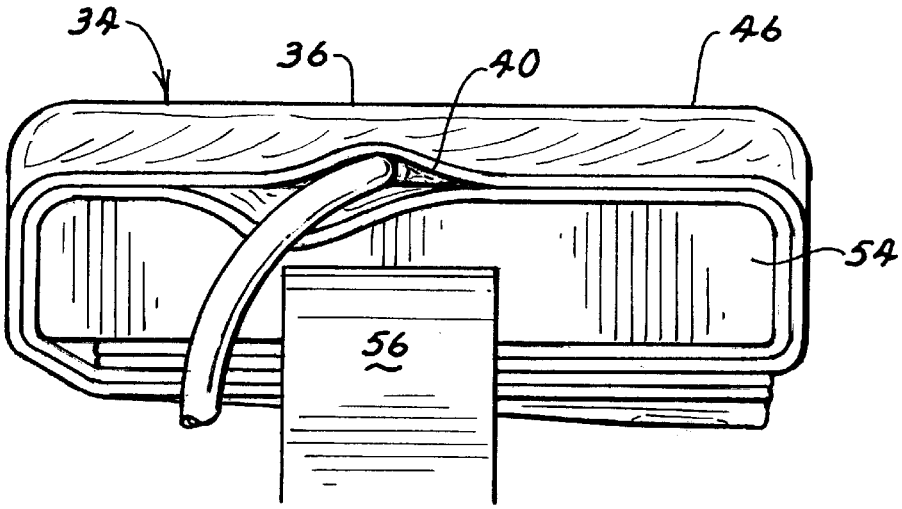
FIG. 4 is an end view of the elongated support member is shown in FIG. 2.
Figure 6:
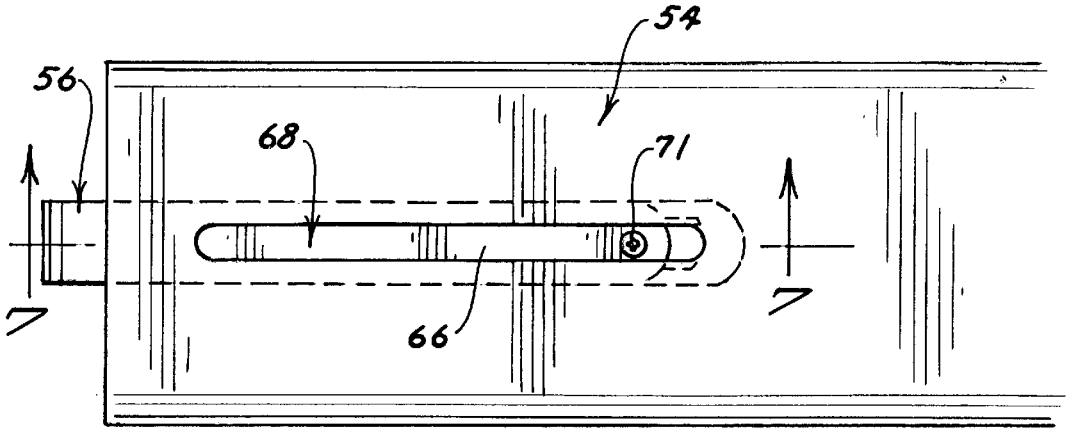
FIG. 6 is a top plan view of the support bar shown in FIG. 3, with the attachment bars assembled.
Figure 7:
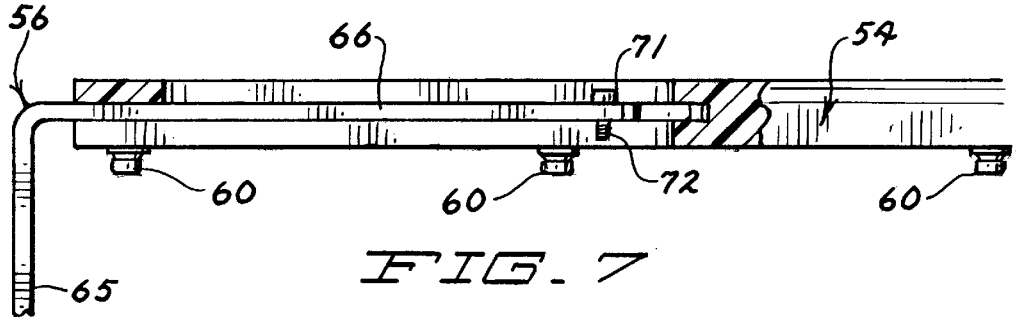
FIG. 7 is a partially cut away side view of the elongated support bar shown in FIG. 3 as seen from the line 7—7 of FIG. 3.
Figure 8:
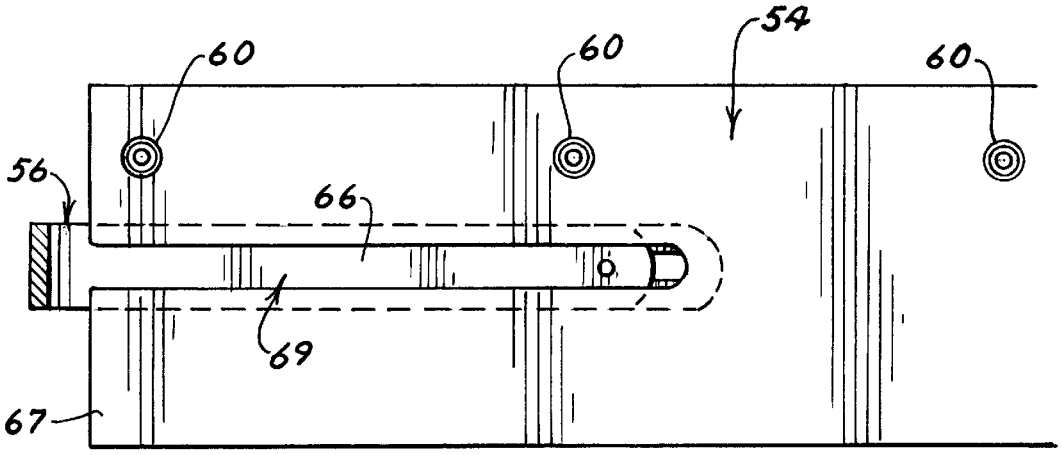
FIG. 8 is a bottom plan view of the elongated support bar shown in FIG. 3 showing the attachment bar and the attachment bar receiving slot partially in phantom.

As shown particularly in the exploded view shown in FIG. 3, a memory foam pad 48 and an inflatable bladder 40 are inserted within an open ended chamber 52 in the outer encasement 46. The outer encasement 46 is then assembled around a block material 54 which provides a secondary support surface 53 for the elongated support member 34. The block material 54 is secured to a pair of attachment bars 56 which are slidably engaged within attachment bar receiving slots 57 within the block material 54 and are secured with screws 58 in the manner illustrated in FIG. 3. The outer casement 46 is secured around the block material 54 once the memory foam pad 48 and the inflatable bladder 40 are inserted within the open-ended chamber 52. The outer casement 46 is secured to the block material 54 by a plurality of snap connectors 59 secured to an outer edge 47 of the outer encasement 46 which are disconnectably individually secured to a plurality of snap receiving screws 60 secured to the bottom side 55 of the block material 54. A cross-sectional view of the elongated support member 34 is shown in FIG. 5 when the bladder 40 is fully inflated. The snap connectors 59 pass through connector openings 61 in the outer encasement 46 to connect with the snap receiving screws 60. The preferred Dartex cover material preferably stretches numerous directions to accommodate the expansion of the bladder 40. An end view of the elongated support member 34 is shown in FIG. 4 when the bladder 40 is completely deflated and a cross-sectional view, showing one of the snap receiving screws 60 in phantom, is shown in FIG. 5 where the bladder 40 is fully inflated. The preferred side rails 32 and the attachment bars 56 of the present invention are heavy gauge steel support bars made of stainless steel or any other suitable material which can provide the necessary support without breaking, bending or otherwise malfunctioning. In alternate embodiments (not shown) other metal materials, composite materials and hardened polymeric materials and combinations thereof can be used for these parts.

The manner of attaching the attachment bars 56 to the block material 54 is illustrated in FIGS. 3–8. The block material 54 is made of relatively hard material such as an inflexible polymeric material, composite materials, metals such as stainless steel wood or wood composites, and combinations of these materials, preferably ultra-high molecular weight UHMW plastic materials such as polyethylene, polycarbonate and the like which are very strong, yet lightweight, inexpensive and easily cleansed. The insertion ends 66 of the attachment bars 56 insert into attachment bar receiving slots 57 in the respective ends 67 of the block material 54. The respective attachment bar receiving slots 57 each have an upper slot 68 and a lower channel 69 in communication with the respective receiving slot 57. The head 71 of a catch screw 72 secured in a screw receiving opening 73 in the insertion end 66 of each attachment bar 56 acts to slidably retain the insertion end 66 of the attachment bar 56 within the receiving slot 57. In this way the length of the support member 34 is easily extended to adjust to differing widths to differing surgical tables (not shown). To attach the support member 34 to the operating room table 10, the attachment bars 56 are slidably adjusted within the receiving slots 57 so that the securing ends 65 of the attachment bars 56 can slide into securing clamps 75 on elongated side rails 32 of the operating room table 10. The clamps 75 are tightened to lock the support member 34 in place relative to the operating room table 10 such that the upper surface 36 of the support member 34 is secured in a position relative to a position of the main surface 38. The elongated support member 34 is secured to elongated side rails 32 using clamps 42 similar to that shown in FIG. 2, however, any known clamps will suffice to secure the support member 34 to the side rail 32 so long as the clamps 42 grip both the attachment bars 56 and the elongated side rails 32 so that the support member 34 cannot be raised or lowered with respect to the main surface 38 or slide with respect to the side rails 32 once the clamps are tightened down to fully grip the attachment bars 56 and the side rails 32. Any well known clamp which will do this is well within the scope of the present invention.

Figure 9:
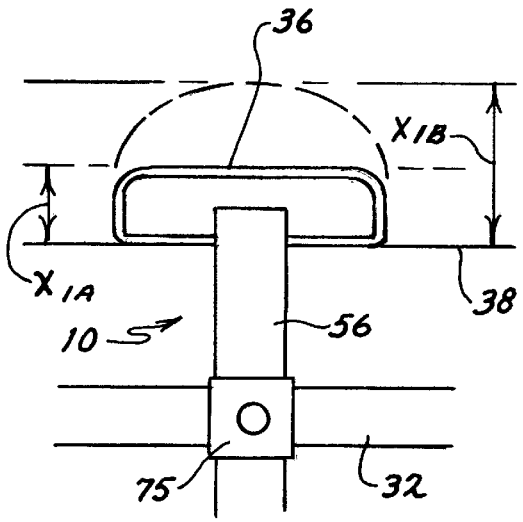
FIG. 9 is a schematic representation of an alternate elongated support member attached to an operating room table and lying on the top of the main surface thereof; the elongated support member is shown with the inflatable bladder in a deflated state, while the inflated profile is shown in phantom.
Figure 10:
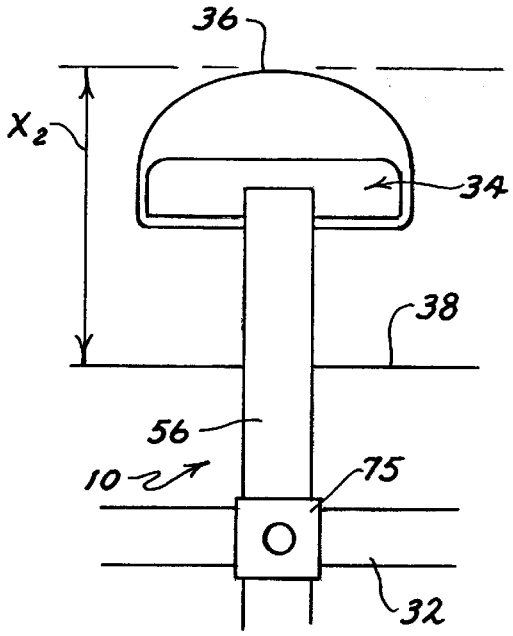
FIG. 10 is a schematic view similar to that shown in FIG. 9, but showing the elongated support member in a raised position above and not in contact with the main surface of the operating room table.

In FIGS. 9 and 10, schematic partial side views of an operating room table 10 like that shown in FIG. 1A are provided. The elongated support member 34 is shown resting upon the main surface 38 of the operating room table 10 in FIG. 9 and the support member 34 is shown in an inflated orientation in phantom. In FIG. 10, the support member 34 is elevated above the main surface 36 and the bladder (not shown) is inflated. As discussed above, the support member 34 can be raised and lowered by loosening the securing clamp 75 to allow the attachment bars 56 to slide up or down with respect to the securing clamp 75 and the respective side rails 32, so as to position the upper surface 36 of the support member 34 at different relative heights (e.g. $X_{1b}$, $X_{2b}$) above the main surface 38. As shown in phantom in FIG. 9, raising the height of the upper surface 36 with respect to the main surface 38 can also be accomplished by inflating the bladder (not shown) within the outer encasement 46 of the elongated support member 34 (see $X_{1b}$). In each of these drawings secondary support surface 53 is above the main surface 38 and the planes $B_3$, $B_4$ in which the secondary surface 53 lies in the respective drawings is parallel to the planes $A_3$, $A_4$ respectively, in which the secondary surface 38 lies.

Figure 11:
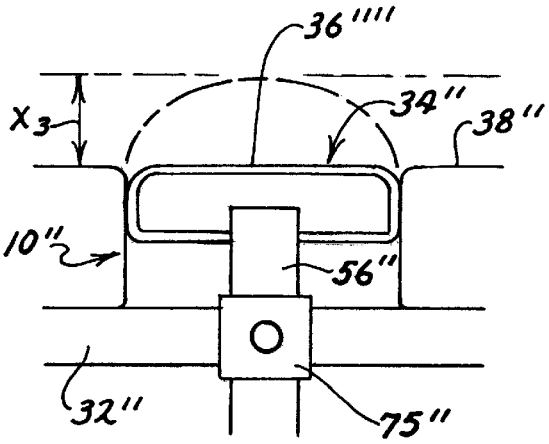
FIG. 11 is a further partial schematic view of an alternate operating room table having a separated main surface providing a recess for the elongated support member and showing the elongated support member in a deflated condition wherein the support surface of the elongated support member is flush with the main surface, while showing the inflated profile in phantom.
Figure 12:
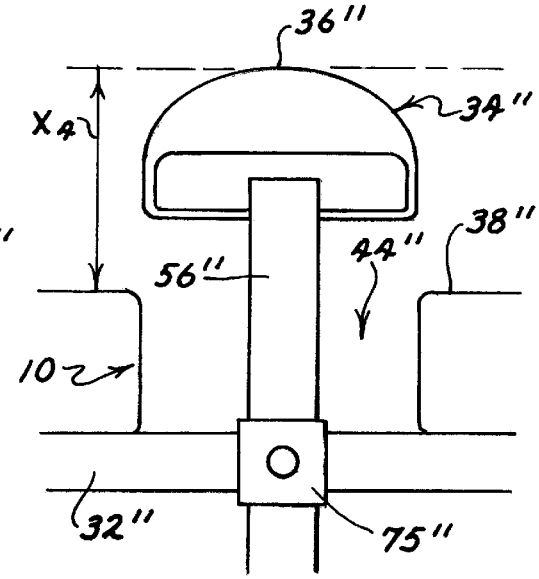
FIG. 12 is a further partial schematic end view of the operating room table shown in FIG. 11 but showing the elongated support member in a raised orientation above the main surface of the operating room table and showing the elongated support member in an inflated state where the bladder has been inflated.

In FIGS. 11 and 12, an alternate operating room table 10" is shown having a recess 44" in which the elongated support member 34" may reside, as shown in FIG. 11. In this way the upper surface 36" of elongated support member 34" may be flush with the main surface 38" when the elongated support member 38", and the bladder (not shown) within the support member 38", is in a deflated orientation. As in the other embodiment, the height of the upper surface 36" can be raised to a height $X_{3b}$ above the main surface 38" by inflating the inflatable bladder (not shown). Whether or not the bladder is inflated, the secondary support surface 53" on the support block 54" is flush with the main surface 38" and the plane $B_5$ in which the secondary surface 53" lies is parallel with the plane $A_5$ in which the main surface lies, and preferably identical to same. As shown in FIG. 12, however, the elongated support member 34" may be raised and adjustably secured to the elongated side rails 32" to raise the upper surface 36" to a height $X_{4b}$ above the main surface 38" and raise the secondary support surface 53" to a height $X_{4a}$ above the main surface 38" . As before, the plane $B_6$ in which the secondary support surface lies is parallel with the plane $A_6$ in which the main surface lies. The support member 34" of the alternate embodiment shown in FIG. 12, preferably has all the elements of the support member 34 shown in FIGS. 2–8 and the operating room table 10 has similar elements as well, with the addition of the recess 44" which creates a main surface 38" which is split into two sections.

It will be appreciated that the preferred operating room tables 10, 10', 10" shown in the drawings are pivotal so that the main surface 38, 38' and 38" can pivot end to end through a vertical plane consistent with the plane of the paper upon which the illustrations of the operating room tables 10, 10', 10" are provided herein. In this way, the preferred operating room tables 10, 10', 10" can be pivoted with respect to the table support system 39, 39", (not shown), respectively, in the manner shown in FIGS. 1A and 1B, respectively, to provide a main surface 38 lying in a first plane $A_1$ which is slanted to place the patient in a Trendelenberg's position (see FIG. 1A) and to provide a main surface 38' lying in a second plane $A_2$ which is slanted to place the patient in a reverse Trendelenberg's position (see FIG. 1B). In each case, the first and second planes $A_1$ and $A_2$ are preferably perpendicular to the vertical plane through which the operating table 10, 10', 10" and the main surface 38, 38', 38" is pivoted end to end.

Figure 13:
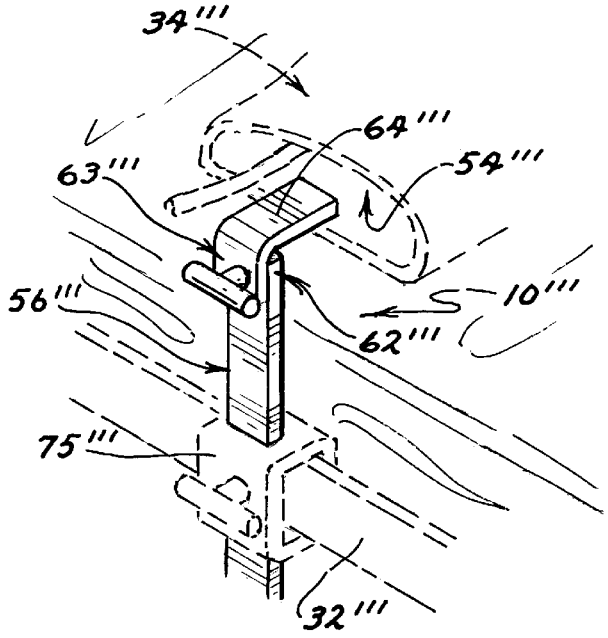
FIG. 13 is a partial perspective view similar to that shown in FIG. 2, showing an alternate elongated support member having attachment bar including a pivotal connection section.
Figure 14:
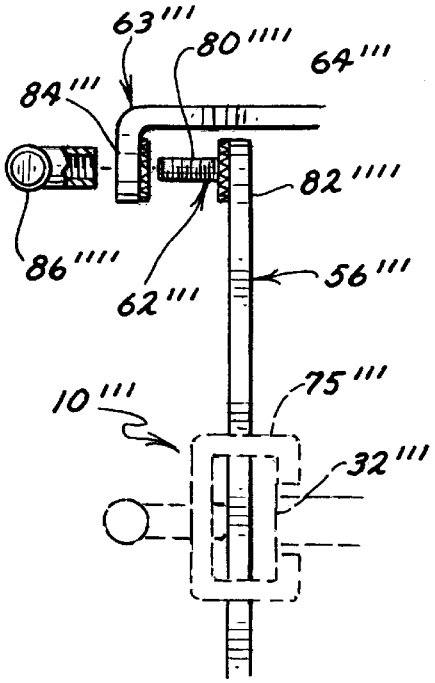
FIG. 14 is an exploded side view of the alternate attachment bar shown in FIG. 13.
Figure 15:
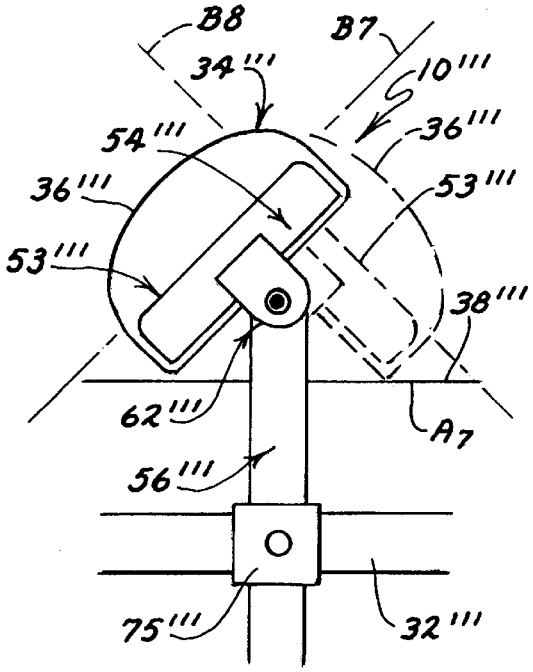
FIG. 15 is a schematic view showing the alternate elongated support member shown in FIGS. 13 and 14.

Referring now also to FIGS. 13–15, portions of an alternate operating room table 10'" the same as that shown in FIGS. 1A, 1B and 2–10 are shown. The alternate table 10'" (shown only part) differs from the table 10 shown in the drawings referenced above only in that the attachment bars 56'" each include pivoted connection sections 62'" having a pivotal connector 63'" which allows the alternate attachment bars 56'" to articulate as shown in FIG. 15. The pivoted connectors 63'" allow pivotal connecting bars 64'" of the attachment bars 56'", which engage the respective ends 67'" of the block material 54'", as well as the block material 54'" and the secondary support surface 53'", to pivot with respect to the side rails 32'" and the main surface 38'". The connector 63'" includes a threaded post 80"" at the attachment and 82"" of the attachment bar 56"", which passes through an opening (not shown) in the distal end 84"" of the pivotal connecting bars 64"", and is mated with a crank nut 86"" which secures the end of the respective pivotal connecting bar 64"" to the attachment end 82"" of the respective attachment bar 56"". As the secondary surface 53'" pivots, the plane (e.g. $B_7$ or $B_8$ as shown in phantom) in which the secondary surface 53'" resides will not remain parallel to the plane $A_7$ in which the main surface 38'" resides. In this way the secondary support surface 38'" can better support the various parts of the patient with which the support member 34'" comes into contact. It is envisioned that this pivot mechanism 63'" will permit the support member 34'" to better engage the patient's body (not shown). This is especially true when the patient (not shown) is placed in Trendelenberg's position and the secondary support surface 53'" is turned toward the patient's buttocks (not shown), and when the patient is placed in reverse Trendelenberg's position, in which case the secondary support surface 53'" will again turn toward the buttocks (not shown) to better engage the buttocks to prevent the patient from sliding downward off the table (not shown).

Figure 16:
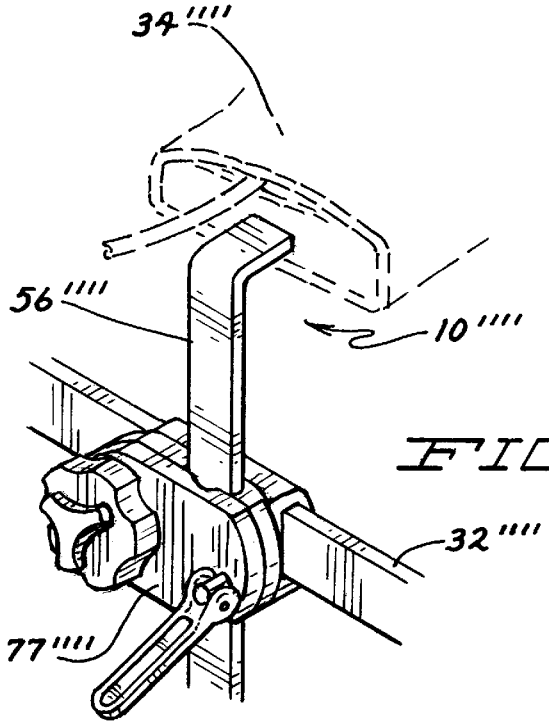
FIG. 16 is a perspective view similar to that of FIG. 2 showing an alternate side rail connector which articulates to permit the elongated support member to articulate with respect to the main surface of the table.
Figure 17:
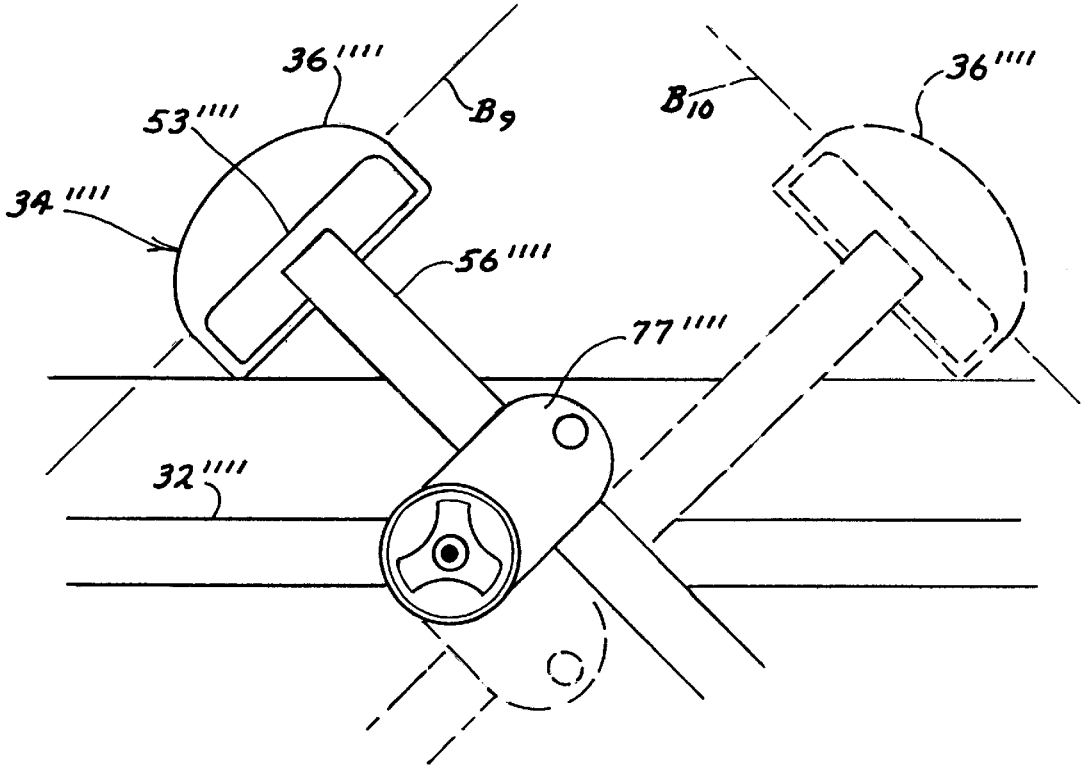
FIG. 17 is a schematic view similar to that shown in FIG. 10, showing the alternate side rail connector in articulated positions with respect to the main surface such that upper surface of the support block lies at an angle to the main surface of the table.

Referring now also to FIGS. 16 and 17, a further alternate embodiment is partially illustrated, similar to the one referenced in the discussion of FIGS. 13–15 in that it is the same, with one exception, as the table 10 shown in the earlier drawings. In this case the exception, or the difference, is the addition of an articulating side rail connector 77"" which adjustably connects the attachment bars 56"" with the side rails 32"". The articulating side rail connector grip the attachment bars 56"" at various heights 80 that the support member 34"" can be adjusted, thereby varying distance from the side rail 32"", and, in some circumstances, the main surface 38"", to the secondary support surface 53"". Although any articulating side rail connector 77"" can be used in the present invention, the most preferred connector is a Tri-clamp (order number 14-TCPA) which is distributed in the United States over the Internet by O.R. Direct, 531 Main Street, Acton, Mass. 01720 and displayed at its website at http://www.ordirect.com/triclamp.htm. The tri-clamp is manufactured by Amatech, Corp., Acton, Mass. Such a connector allows the secondary support surface 53"" and the elongated support member 34"" to articulate with respect to the side rails 32"" so that the secondary surface 53"" can reside in a plane (e.g. plane $B_9$ or plane $B_{10}$) which is oriented at an angle to the plane $A_9$ in which the main surface 38"" resides, thus enabling this embodiment to provide virtually all of the advantages of the embodiment shown in FIGS. 13–15. Because of the length of the distance between the secondary surface 53"" and the articulating joint at the side rail 32"", this embodiment is somewhat more restricted in the degree to which this embodiment can be used to pivot the secondary support surface 53"", however, this limitation is not seen as a significant limitation.

As used herein, the following terms or phrases have the indicated meanings: a vertical plane is a plane perpendicular with a horizontal plane; a plane is perpendicular to another plane is one which is oriented at an angle of 90° with respect to the other; a plane which is parallel with another plane is one which does not lie at an angle to the other plane and lines on the surface of each of the respective planes, which are oriented in the same direction will be parallel lines; "consistent with" means parallel to or parallel with; pivoting or pivoted "through a plane" means that the arc, through which an object or a plane pivots when it is pivoting or pivoted through a plane, is consistent with or falls within a plane; for instance, if a surface pivots through a vertical plane to which a separate plane in which surface lies is perpendicular, then each point on the surface will pass through an arc which will lie in a vertical plane; "compressible cushioning capacity" means the capacity for absorbing force by gas compression within an inflatable bladder; "generally in a downward direction" means in a direction generally toward the earth; and "above" means in a position higher than another position relative to the general position of the surface of the earth.

It is to be understood, however, that even though numerous characteristics and advantages of the present invention have been set forth in the foregoing description, together with details of the structure and function of the present invention, sequence or order of the specific steps, or actual composition materials used may vary somewhat. Furthermore, it will be appreciated that this disclosure is illustrative only and that changes may be made in detail, especially matters of shape, size, arrangement of parts or the sequence or elements of aspects of the invention will fall within the principles of the invention to the fullest extent indicated by the broad general meaning of the terms of which the appended claims, which form a further part hereof, are expressed.

What is claimed is:

1. A pivotal operating room table, comprising:

a main patient support section having a main surface, the main surface lying generally in a first plane, the main patient support section being pivotally interconnected with a table support system such that the first plane can pass through a second generally vertical plane as the main patient support section pivots with respect to the table support system, and as the main surface pivots end to end; the second plane being generally perpendicular to the first plane; and an elongated support member adjustably interconnectable to the main patient support section, the support member having an elongated support block, the support block having an upper surface area which includes a support surface lying generally in a third plane, the third plane being generally perpendicular to the second plane when the elongated support member is interconnected with the main patient support section; the elongated support member being adjustably interconnectable with the main patient support section at any of a plurality of heights above the main surface; the elongated support member further including an inflatable bladder resting upon the upper surface area of the elongated support block.

2. The pivotal operating room table of claim 1 further comprising a pair of elongated, parallel side rails on opposite sides of the main patient support section, the side rails being interconnected with the main patient support section and oriented generally parallel with the main surface; the elongated support member having a pair of attachment bars interconnected with opposite ends of the support block; the elongated support block being adjustably interconnected with each of the respective side rails by one of the pair of attachment bars.

3. The pivotal operating room table of claim 1, wherein the third plane is generally parallel with the first plane when the elongated support member is interconnected with the main patient support section.

4. The pivotal operating room table of claim 2, wherein the attachment bars are adjustably attached to the support block.

5. The pivotal operating room table of claim 2, wherein each of the pair of attachment bars include pivotal connection sections within the respective attachment bar, each pivotal connection section including a pivotal connector which permits each attachment bar to articulate, wherein the upper surface of the support block can articulate with respect to the main patient support section such that the third plane can articulate generally through a fourth plane generally perpendicular to the first and third planes and generally parallel with the second plane when the elongated support member is interconnected with the main patient support section.

6. The pivotal operating room table of claim 2, further comprising a pair of articulating side rail connectors, each of the articulating side rail connectors interconnecting one of the pair of attachment bars with a respective side rail such that when the support member is interconnected with the main patient support section: (1) each of the attachment bars can articulate with respect to the side rails and the main patient support section; (2) the upper surface of the support block can articulate with respect to the main patient support section; and (3) the third plane can articulate generally through a fourth plane which is generally perpendicular to the first and third planes and generally parallel with the second plane.

7. An elongated support attachment for attachment to a pivotal operating room table, the operating room table having a main patient support section having a main surface and a pair of parallel side rails on opposite sides of the main surface, the side rails being interconnected with the main patient support section and oriented generally in parallel with the main surface, the main surface lying generally in a first plane; the main patient support section being pivotally interconnected with a table support system such that the first plane can pass through a second generally vertical plane as the main patient support section pivots with respect to the table support system, and as the main surface pivots end to end, the second plane being generally perpendicular to the first plane; the elongated support attachment comprising:

an elongated support member interconnectable to the pivotal operating room table at a number of heights above the main surface; the elongated support member having a relatively hard underlying support surface and a relatively soft compressible overlying support covering above the underlying support surface, the overlying support covering including relatively soft support materials such that the overlying support covering can be compressed when bearing weight; the support materials including an expandable bladder which can be inflated and deflated so as to contain varying amounts of air and so as to provide varying amounts of compressible cushioning capacity.

8. The elongated support attachment of claim 7, the support member having an elongated support block, the support block having an upper surface area which includes a support surface lying generally in a third plane, the third plane being generally perpendicular to the second plane when the elongated support member is interconnected with the main patient support section; the elongated support member further including a pair of attachment bars adjustably interconnected with opposite ends of the support block; the elongated support block being adjustably interconnected with each of the respective side rails by one of the pair of attachment bars.

9. The elongated support attachment of claim 8, wherein each of the pair of attachment bars include pivotal connection sections within the respective attachment bar, each pivotal connection section including a pivotal connector which permits the attachment bar to articulate, wherein the upper surface area of the support block can articulate with respect to the main patient support section such that the third plane can articulate generally through a fourth plane generally perpendicular to the first and third planes and generally parallel with the second plane when the support member is interconnected with the main patient support section.

10. An operating room table for a patient, the patient having a back including an upper lumbar region and buttocks separated by a lower lumbar region, the operating room table comprising:

a table support system; a main patient support section pivotally interconnected with the table support system; and an elongated support member adjustably interconnected to the main patient support section; the main patient support section having a main surface which can provide support for the patient when the patient is resting in a supine position; the elongated support member having a secondary surface, the secondary surface having a smaller surface area than the surface area of the main surface; each of the main and secondary surfaces having a length and a width; in each case, the length being greater than the width; the length of the main surface being a first length and the length of the secondary surface being a second length, wherein the second length is generally perpendicular to the first length and the secondary surface can be adjustably fixed at any of a plurality of positions above the main surface so as to provide support for the lower lumbar region of the patient's back in such a way that the lower lumbar region can rest upon the secondary surface at a position which is above the main surface while the buttocks are resting on the main surface; the main surface and the secondary surface being simultaneously pivotal with respect to a horizontal plane along a vertical plane consistent with the first length; the elongated support member including a support block, having a relatively hard underlying support surface, and a relatively soft compressible overlying support covering above the underlying support surface, the overlying support covering including relatively soft support materials such that the overlying support covering can be compressed when bearing weight; the support materials including an expandable bladder which can be inflated and deflated so as to contain varying amounts of air and so as to provide varying amounts of compressible cushioning capacity.

11. The operating room table of claim 10, wherein the pivotal operating room table has a pair of elongated, parallel side rails attached to the main patient support section on opposite sides of the main surface which are generally parallel with the main surface; the elongated support member being interconnectable with of the elongated side rails such that the a secondary surface on an upper side of the elongated support block is generally parallel with the main surface.

12. The operating room table of claim 11, the support member having an elongated support block and a pair of attachment bars adjustably interconnected with opposite ends of the support block; the elongated support block being adjustably interconnected with each of the respective side rails by one of the pair of attachment bars.

13. The operating room table of claim 12, wherein each of the pair of attachment bars include pivotal connection sections within the respective attachment bar, each pivotal connection section including a pivotal connector which permits each attachment bar to articulate, wherein the support block can articulate with respect to the main patient support section when the support member is interconnected with the main patient support section.

14. The operating room table of claim 12, further comprising a pair of articulating side rail connectors, each of the articulating side rail connectors interconnecting one of the pair of attachment bars with a respective side rail such that each of the attachment bars can articulate with respect to the side rails and the main patient support section and the upper surface of the support block can articulate with respect to the main patient support section when the support member is interconnected with the main patient support section.

15. A pivotal operating room table, comprising:

a main patient support section having a main surface, the main surface lying generally in a first plane, the main patient support section being pivotally interconnected with a table support system such that the first plane can pass through a second generally vertical plane as the main patient support section pivots with respect to the table support system, and as the main surface pivots end to end; the second plane being generally perpendicular to the first plane; and an elongated support member adjustably interconnected to the main patient support section, the elongated support member having an elongated support block, the support block having an upper surface area which includes a support surface lying generally in a third plane, the third plane being generally perpendicular to the second plane when the elongated support member is interconnected with the main patient support section; the elongated support member being adjustably interconnected with the main patient support section such that the upper surface area can be fixed at any of a plurality of heights above the main surface; the support block being pivotally interconnected with the main patient support section such that the support surface can be pivoted with respect to the main surface through a fourth plane generally parallel with the second plane and generally perpendicular to the first and third planes;

the pivotal operating room table further comprising a pair of elongated, parallel side rails on opposite sides of the main patient support section, the side rails being interconnected with the main patient support section and oriented generally parallel with the main surface; the support member having a pair of attachment bars interconnected with opposite ends of the support block; the elongated support block being adjustably interconnected with each of the respective side rails by one of the pair of attachment bars;

the pivotal operating room table further comprising a pair of articulating side rail connectors, each of the articulating side rail connectors, each of the articulating side rail connectors interconnecting one of the pair of attachment bars with a respective side rail such that when the support member is interconnected with the main patient support section: (1) each of the attachment bars can articulate with respect to the side rails and the main patient support section; (2) the upper surface of the support block can articulate with respect to the main patient support section; and (3) the third plane can articulate generally through a fourth plane which is generally perpendicular to the first and third planes and generally parallel with the second plane.

16. The pivotal operating room table of claim 15, the elongated support member further including an inflatable bladder resting upon the upper surface area of the elongated support block.

17. The pivotal operating room table of claim 15, wherein the attachment bars are adjustably attached to the support block.

18. The pivotal operating room table of claim 15, wherein each of the pair of attachment bars include pivotal connection sections within the respective attachment bar, each pivotal connection section including a pivotal connector which permits the respective attachment bar to articulate, wherein the upper surface of the support block can articulate with respect to the main patient support section such that the third plane can articulate generally through a fourth plane generally perpendicular to the first and third planes and generally parallel with the second plane when the support member is interconnected with the main patient support section.

19. A method of supporting a patient on a pivotal surface during a surgical procedure; the patient having a head and a back, the back including shoulders, buttocks, and a lumbar region interconnecting the shoulders and the buttocks, the lumbar region having an upper lumbar region proximate the shoulders and a lower lumbar region proximate the buttocks, and the buttocks having an upper portion immediately adjacent the lower lumbar region; the pivotal surface being pivotal so that the patient's buttocks can be elevated with respect to the head when the patient is lying supine on the pivotal surface; said method comprising.

(a) providing a pivotal operating room table having a table support system; a main patient support section pivotally interconnected with the table support system; and an elongated support member adjustably interconnected to the main patient support section; the main patient support section having a main surface which can provide support for the patient when the patient is resting in a supine position; the elongated support member having a secondary surface; the elongated support member being adjustably secured relative to the main surface such that the secondary support surface is positioned above the main surface;

(b) positioning the patient supine on both the main surface and the secondary support surface such that the secondary support surface is in contact with the lower lumbar region of the patient's back; and (c) orienting the main surface by pivoting the main patient support section with respect to the table support system such that the patient's buttocks are elevated above the patient's head in a Trendelenberg's position; wherein the secondary support surface is positioned immediately below the lower lumbar region of the patient's back proximate the upper portion of the patient's buttocks to provide resistance gravitational forces biasing the patient in a generally downward direction.

20. The method of claim 19, the elongated support member including a support block, having a relatively hard underlying support surface, and a relatively soft compressible overlying support covering above the underlying support surface, the overlying support covering including relatively soft support materials such that the overlying support covering can be compressed when bearing weight; the support materials including an expandable bladder which can be inflated and deflated so as to contain varying amounts of air and so as to provide varying amounts of compressible cushioning capacity; wherein the step of positioning includes inflating the bladder to permit the secondary support surface to conform in part to the shape of the patient's back proximate the lower lumbar region where the elongated support member comes into contact therewith.

21. The method of claim 19, the elongated support member having an elongated support block, the support block having an upper surface area which includes the secondary support surface; the elongated support member being adjustably interconnected with the main patient support section such that the upper surface area can be fixed at any of a plurality of heights above the main surface; the elongated support block being pivotally interconnected with the main patient support section such that the secondary support surface can be pivoted with respect to the main surface; the step of positioning including pivoting the secondary support surface such that the elongated support member is in contact with the upper portion of the patient's buttocks immediately adjacent the lower lumbar region.

* * * * *